United States Patent [19]

DeBold et al.

[11] Patent Number: 4,832,765

[45] Date of Patent: May 23, 1989

[54] DUPLEX ALLOY

[75] Inventors: Terry A. DeBold, Wyomissing; David A. Englehart, Shillington; James W. Martin, Spring Township, Berks County, all of Pa.

[73] Assignee: Carpenter Technology Corporation, Reading, Pa.

[21] Appl. No.: 15,584

[22] Filed: Feb. 17, 1987

Related U.S. Application Data

[63] Continuation of Ser. No. 773,857, Sep. 9, 1985, abandoned, which is a continuation of Ser. No. 455,870, Jan. 5, 1983, abandoned.

[51] Int. Cl.[4] ..... C22C 38/22

[52] U.S. Cl. ..... 148/325; 420/67; 420/65

[58] Field of Search ..... 148/335; 420/65, 67, 420/57, 58, 59

[56] References Cited

U.S. PATENT DOCUMENTS

| | | | |
|---|---|---|---|
| 3,567,434 | 3/1968 | Richardson et al. | 420/58 |
| 3,865,644 | 2/1975 | Hellner et al. | 420/57 |
| 4,032,367 | 6/1977 | Richardson et al. | 148/327 |
| 4,055,448 | 10/1977 | Fujikura et al. | 148/327 |
| 4,101,347 | 7/1978 | Fujikura et al. | 148/327 |
| 4,119,765 | 10/1978 | Pinnow et al. | 428/683 |
| 4,141,762 | 2/1979 | Yamaguchi et al. | 148/327 |
| 4,155,752 | 5/1979 | Oppenheim et al. | 75/128 G |
| 4,272,305 | 6/1981 | Weingerl et al. | 148/327 |
| 4,340,432 | 7/1982 | Hede | 148/11.5 P |

FOREIGN PATENT DOCUMENTS

| | | | |
|---|---|---|---|
| 2032945 | 1/1972 | Fed. Rep. of Germany . | |
| 2153186 | 5/1973 | Fed. Rep. of Germany | 75/126 C |
| 2348292 | 12/1974 | Fed. Rep. of Germany | 75/128 W |
| 2457089 | 6/1975 | Fed. Rep. of Germany | 148/38 |
| 716 | 1/1977 | Japan | 75/128 E |
| 52716 | 1/1977 | Japan . | |
| 46117 | 4/1979 | Japan | 75/128 E |
| 5446117 | 4/1979 | Japan . | |
| 44528 | 3/1980 | Japan | 148/37 |
| 5544528 | 3/1980 | Japan . | |
| 44757 | 4/1981 | Japan | 75/128 E |
| 5644757 | 4/1981 | Japan . | |
| 142855 | 11/1981 | Japan | 148/37 |
| 56142855 | 11/1981 | Japan . | |
| 47852 | 3/1982 | Japan | 148/37 |
| 1248980 | 10/1971 | United Kingdom . | |

OTHER PUBLICATIONS

Sandvik 3RE60, Stainless Steel with High Resistance to Stress Corrosion Cracking, Sanvik Steel Catalogue, 1.25E, Mar. 1976, pp. 2, 8 & 9.

Avesta Jernverks AB, Information Sheet No. 7416, re: Avesta 453S Welding Electrodes, (1980).

ASTM Specification A268-81, "Seamless and Welded Ferritic Stainless Steel Tubing for General Service", pp. 200-206, (1981).

Bungardt et al., "Untersuchungen über das Superplastische Verhalten Ferritisch-Austenitischer Chrom--Nickel (Molybdän)-Stähle", *DEW-Technische Berichte*, vol. 10, issue No. 2, pp. 85-96, (1970).

Carpenter Technology Corporation, Tube Division, Technical Data Sheet: "Carpenter Stainless 7-Mo, (Type 329)", (1974).

Firth Vickers Foundry Limited, Brochure: "Firth Vickers FMN Casting Alloy", (no date).

Firth Vickers Foundry Limited, Reprint of: Matthews, "Properties of Duplex Austenitic Ferritic Stainless Steels", *The Metallurgist and Materials Technologist*, (May 1982).

Firth Vickers Foundry Limited, NACE Uniform Material Testing Report Form, (Dec. 10, 1981).

Irving, "Duplex Stainless Keeps Corrosion in Check", *Iron Age*, pp. 93-94, (May 4, 1981).

Lawson et al., "Evaluating Material Performance in a 3000-GPD Stainless Steel Desalination Test Plant", *Materials Performance*, pp. 11-16, (Mar. 1974).

Nordin (Uddeholm Steel Research), "Condensate of Research Report No. FM76-865-3", (1977).

Nordin, "Properties of a Modified Type 329 Weldable and SCC Resistant Stainless Steel", *Metaux Corrosion-Industries*, No. 659-660, pp. 229-240, (Jul.-Aug. 1980).

SKF Industries, Inc., Material Specification No. 471,878, re: Type 329 Steel, (1966).

Stahlschlüssel Key to Steel, 11th Edition, C. W. Wegst, Ed., Verlag Stahlschlüssel Wegst, KG., Marbach, pp. 255 and 307, (1977).

Wessling et al., "Properties and Applications of a Recently Developed Ferritic/Austenitic Steel Containing 0.02% C, 22% Cr, 3% Mo and 0.12% N in Comparison with Molybdenum-Alloyed Austenitic Steels", *Stainless Steel* 1977, published by Climax Molybdenum, Inc., pp. 217-225, (1977).

*Primary Examiner*—Deborah Yee

*Attorney, Agent, or Firm*—Edgar N. Jay; Vincent T. Pace

[57] ABSTRACT

A stainless duplex ferritic-austenitic steel with improved corrosion resistance. The steel consists essentially of about: 0.03 w/o Max. carbon, 3.0 w/o Max. manganese, 1.0 w/o Max. silicon, 26.0 to 29.0 w/o chromium, 3.5 to 5.2 w/o nickel, 3.5 w/o Max. molybdenum, 0.15 w/o Min. nitrogen and the balance essentially iron. The steel preferably contains about 0.17 to 0.35 w/o nitrogen for improved pitting resistance and for increased austenite content. Welds of the steel preferably contain at least about 17% austenite in the as-welded condition for improved pitting and intergranular corrosion resistance.

31 Claims, No Drawings

DUPLEX ALLOY

This application is a continuation of our application Ser. No. 773,857, filed Sept. 9, 1985, now abandoned, which in turn was a continuation of our application Ser. No. 455,870, filed Jan. 5, 1983, now abandoned.

BACKGROUND OF THE INVENTION

This invention relates to a stainless duplex ferritic-austenitic steel having a unique combination of good mechanical properties and good corrosion resistance properties.

Heretofore, a stainless duplex ferritic-austenitic steel, designated AISI Type 329, has been commercially available with: a) good mechanical properties such as high annealed yield strength; and b) good corrosion resistance such as resistance to general corrosion in the presence of strong oxidizing agents (e.g., boiling nitric acid). Typical uses for Type 329 steel have included tube or pipe for heat exchange applications involving severely corrosive, oxidizing environments such as are found in the petroleum refining, petrochemical, chemical, and pulp and paper industries (e.g., in nitric acid cooler-condensers). Type 329 steel has typically had a composition of about 0.08 weight percent (w/o) Max. carbon, 1.0 w/o Max. manganese, 0.75 w/o Max. silicon, 23.0 to 28.0 w/o chromium, 2.5 to 5.0 w/o nickel, 1.0 to 2.0 w/o molybdenum, with the balance essentially iron. Compositions similar to Type 329 steel have been sold, containing down to about .02 w/o carbon, up to about 2 w/o manganese, up to about 6 w/o nickel, up to about 30 w/o chromium, up to about 3.5 w/o molybdenum and/or up to about 0.25 w/o nitrogen.

However, the resistance to intergranular corrosion in the presence of strong oxidizing agents and the resistance to pitting in the presence of halides, particularly chlorides, of Type 329 steel has left something to be desired in areas of the steel which have been welded, particularly in areas which have been welded but not subsequently annealed (e.g., in areas of a tube, formed from the steel, which have been welded into a tube sheet of a heat exchanger). Hence, a steel has been sought with mechanical properties and corrosion resistance properties at least as good as Type 329 steel and with intergranular corrosion resistance and pitting resistance, as welded or as welded plus annealed, that are superior to Type 329 steel.

SUMMARY OF THE INVENTION

In accordance with this invention, a stainless duplex ferritic-austenitic steel is provided, the broad, preferred and particularly preferred forms of which are conveniently summarized as consisting essentially of about:

| Elements | Broad Ranges (w/o) | Preferred Ranges (w/o) | Particularly Preferred Ranges (w/o) |
|---|---|---|---|
| C | .03 Max. | .01–.028 | .015–.025 |
| Mn | 3.0 Max. | 1.0 Max. | 0.5 Max. |
| Si | 1.0 Max. | 0.75 Max. | 0.5 Max. |
| Cr | 26.0–29.0 | 26.0–28.0 | 26.5–27.5 |
| Ni | 3.5–5.2 | 4.0–5.0 | 4.5–5.0 |
| Mo | 3.5 Max. | 1.0–2.5 | 1.25–2.25 |
| Cu | 2.0 Max. | 1.0 Max. | 1.0 Max. |
| B | .005 Max. | | |
| N | 0.15 Min. | 0.17–0.35 | 0.18–0.28 |

The remainder of the steel is iron except for incidental impurities which can comprise: up to about 0.04 w/o, preferably up to about 0.025 w/o, phosphorous; up to about 0.03 w/o, preferably up to about 0.005 w/o, sulphur; up to about 0.2 w/o tungsten; up to about 0.25 w/o vanadium; up to about 0.2 w/o cobalt; and up to about 0.1 w/o of elements such as aluminum, calcium, magnesium and titanium and up to about 0.1 w/o of misch metal which can be used in refining the steel.

In the foregoing tabulation, it is not intended to restrict the preferred ranges of the elements of the steel of this invention for use solely in combination with each other or to restrict the particularly preferred ranges of the elements of the steel for use solely in combination with each other. Thus, one or more of the preferred ranges can be used with one or more of the broad ranges for the remaining elements and/or with one or more of the particularly preferred ranges for the remaining elements. In addition, a preferred range limit for an element can be used with a broad range limit or with a particularly preferred range limit for that element.

The steel of this invention has: a) the good mechanical properties of Type 329 steel; and b) corrosion resistance properties, particularly resistance to intergranular corrosion and pitting in weld areas, that are superior to Type 329 steel.

DETAILED DESCRIPTION OF THE INVENTION

In the stainless duplex ferritic-austenitic steel of this invention, carbon, which is a strong austenite former, is kept to a minimum to minimize the formation of chromium-rich carbonitrides or carbides (e.g., $M_{23}C_6$) at grain boundaries when the steel is heated. In this regard, no more than about 0.03 w/o carbon, preferably no more than about 0.025 w/o carbon (e.g., down to about 0.001 to 0.005 w/o carbon), is utilized. Thereby, the susceptibility of the steel to intergranular corrosion is reduced. About .01 w/o carbon is considered a practical and hence preferred, but not an essential, minimum because of the cost of reducing the carbon below about 0.01 w/o. A particularly preferred range for carbon is about 0.015 to 0.025 w/o.

Manganese is an austenite former and also increases the solubility of nitrogen in the steel of this invention. In addition, manganese is a scavenger for unwanted elements (e.g., sulfur). Hence, at least about 0.2 w/o manganese is preferably present in the steel. However, manganese can promote the formation of sigma phase which, if present: (a) makes the steel hard and brittle and thereby makes it difficult to handle and work the steel; and (b) makes the steel prone to corrosion. Also, most of the benefit from having manganese present can be attained with up to about 3.0 w/o manganese, and more than about 1.0 w/o manganese may adversely affect the pitting resistance of the steel. Hence, only up to about 3.0 w/o manganese is utilized in the steel. Preferably, no more than about 1.0 w/o, better yet no more than about 0.5 w/o, manganese is present in the steel.

Silicon acts as a deoxidizing agent and a strong ferrite former. Silicon also improves the weldability of the steel by increasing the fluidity of the steel when it is molten. Hence, at least about 0.2 w/o silicon is preferably present in the steel. However, silicon promotes the formation of sigma phase. Hence, only up to about 1.0 w/o silicon is utilized in the steel. Preferably, no more than about 0.75 w/o, better yet no more than about 0.5 w/o, silicon is present in the steel.

Chromium is a ferrite former and provides significant corrosion resistance to the steel of this invention. In this regard, chromium provides significant resistance to: (a) general and intergranular corrosion in the presence of strong oxidizing agents such as nitric acid heated above its atmospheric boiling point; and (b) pitting in the presence of chlorides. Chromium also increases the solubility of nitrogen in the steel. Hence, at least about 26.0 w/o chromium is present in the steel. However, chromium promotes the formation of sigma phase. Hence, no more than about 29.0 w/o chromium is utilized in the steel, and preferably no more than about 28.0 w/o chromium is utilized. The use of about 26.5 to 27.5 w/o chromium is particularly preferred in the steel, bu the use of about 28.0 to 29.0 w/o chromium may be preferred for providing corrosion resistance if little or no (e.g., about 0.2 w/o Max.) molybdenum is used in the steel.

Nickel is a strong austenite former, and for this reason, at least about 3.5 w/o nickel is present in the steel of this invention. Nickel also provides general corrosion resistance in acid environments, particularly in sulfuric acid. However, nickel is relatively expensive. Nickel also decreases the solubility of nitrogen in the steel and promotes the formation of sigma phase. Moreover, most of the corrosion resistance benefits, obtained by adding nickel, can be attained with up to about 5.2 w/o nickel. Hence, not more than about 5.2 w/o nickel is present in the steel. Preferably, about 4.0 to 5.0 w/o, better yet about 4.5 to 5.0 w/o, nickel is used in the steel.

Molybdenum is a strong ferrite former and, if added to the steel of this invention, provides significant corrosion resistance, particularly pitting resistance. Molybdenum also increases the solubility of nitrogen in the steel. However, molybdenum promotes the formation of sigma phase, and hence, not more than about 3.5 w/o molybdenum, preferably not more than about 2.5 w/o molybdenum, is used. Preferably, at least about 1.0 w/o molybdenum is present in the steel for pitting resistance. It is particularly preferred that the steel contain about 1.25 to 2.25 w/o molybdenum for use in a wide variety of corrosive environments, particularly those containing chlorides. However, for corrosive environments containing little or no chlorides, it is contemplated that the steel can contain little or no (e.g., about 0.2 2/o Max.) molybdenum.

In a preferred steel of this invention, the total of chromium w/o plus nickel w/o plus molybdenum w/o in the steel does not exceed about 34.0 and the total of nickel w/o plus molybdenum w/o does not exceed about 7.0. This inhibits sigma phase formation during the processing of this preferred steel which could adversely affect the workability and the corrosion resistance of the steel. By so limiting the total of chromium, nickel and molybdenum, the workability of this preferred steel is made comparable to Type 329 steel, and this steel can be processed in the same general manner as Type 329 steel, as will be described below, to remove any minor amounts of sigma phase that might form. In this regard, by controlling the total of chromium, nickel and molybdenum in this preferred steel, the hardness of the steel is kept from exceeding about 30 on the Rockwell C (Rc) scale when the steel is sensitized by heating at 1400 F (760 C) for two hours and then air cooling. By so limiting the total of chromium, nickel and molybdenum, the risk of forming sigma phase in weld areas of this preferred steel, as a result of the welding process, is also substantially reduced. Of course, the total of chromium, nickel and molybdenum in the steel of this invention need not be so limited, provided sigma phase formation is not a problem in the processing or welding of the steel. For example, the total of chromium, nickel and molybdenum need not be so limited: (a) if the dimensions of the articles (including intermediate and final shaped articles), formed from the steel, allow the articles to be rapidly cooled through the sigma phase sensitization range of about 1250 to 1650 F (about 675 to 900 C); or (b) if any sigma phase can subsequently be removed in a conventional manner from the articles.

Copper, if added to the steel of this invention, can provide significant corrosion resistance, particularly resistance to general corrosion in acids such as sulfuric acid. Copper is also an austenite former. However, most of the benefit from adding copper can be attained with up to about 2.0 w/o copper, and more than about 1.0 w/o copper can adversely affect pitting resistance. For these reasons and to minimize the cost of the steel, copper is limited to 2.0 w/o maximum, preferably 1.0 w/o maximum.

Nitrogen is a strong austenite former and contributes to the tensile strength and pitting resistance of the steel of this invention. Nitrogen also seems to inhibit the formation of sigma phase. Hence, nitrogen can be present in the steel up to its limit of solubility, which may be up to about 0.4 w/o, provided the steel is not to be welded or heated for a prolonged period at a temperature at which nitrides or carbonitrides could form, i.e., at about 1050 to 1750 F (about 565 to 955 C). In accordance with this invention, the steel contains a minimum of about 0.15 w/o nitrogen. When the steel is to be welded, it is preferred that the steel contain at least about 0.17 w/o, better yet at least about 0.18 w/o, nitrogen to provide enhanced pitting resistance and high levels, i.e., at least about 17%, of austenite in weld areas of the steel, even without subsequent annealing. When the steel is to be welded, it is also preferred that the nitrogen content not exceed about 0.35 w/o, better yet about 0.28 w/o, to avoid porosity in the weld. In this regard, when nitrogen exceeds the stated preferred limits, some of the nitrogen in solid solution can come out of solution during welding and can be trapped during subsequent solidification of the steel. This can produce pores in the weld area, thereby making the weld area prone to corrosion and mechanical failure. Thus, to assure good weldability of the steel by conventional welding techniques, nitrogen in the steel is preferably limited, for example, to: about 0.28 w/o Max. when using autogenous gas tungsten arc (GTA) welding techniques; and about 0.35 w/o Max when using electron beam welding or laser welding techniques.

In the steel of this invention, it is preferred that the austenite formers, nickel, manganese, copper and carbon, not be present in minimum amounts in the steel when the ferrite formers, chromium, silicon and molybdenum, are present in maximum amounts. In this regard, one should not rely on using nitrogen to form austenite in the steel when the remainder of the alloy balance would produce a totally ferritic structure such as would be obtained with a significant excess of ferrite formers, beyond the levels required to produce 100% ferrite. This is because, when the steel is heated (e.g., welded), nitrogen may form chromium nitrides, thereby reducing the amount of nitrogen that is present interstitially in the austenite and that stabilizes the austenite.

Up to about 0.005 w/o boron can be present in the steel of this invention. In this regard, a small but effective amount (e.g., 0.0005 w/o or more) of boron can be used, because it is believed to have a beneficial effect on corrosion resistance, as well as hot workability.

Small amounts of one or more other elements may also be present in the steel because of their beneficial effect in refining (e.g., deoxidizing and/or desulfurizing) the melt. For example, elements such as calcium, magnesium, aluminum and/or titanium, in addition to silicon, can be added to the melt to aid in deoxidizing and also to benefit hot workability as measured by high temperature ductility. When added, the amounts of such elements should be adjusted so that the amounts retained in the steel do not undesirably affect corrosion resistance or other desired properties. Misch metal (a mixture of rare earths primarily comprising cerium and lanthanum) can also be added to the melt for, inter alia, removing sulfur, and its use is believed to have a beneficial effect upon hot workability. However, for that effect, no definite amount of misch metal need be retained in the steel because its beneficial effect is provided during the melting process when, if used, up to about 0.4 w/o, preferably no more than about 0.3 w/o, is added.

In a preferred steel of this invention containing about 0.17 to 0.35 w/o nitrogen, the elements are preferably balanced so that the value of the chromium equivalent ("Cr Eq.") minus the nickel equivalent ("Ni Eq."), calculated by the following equations, is no more than about 16.4, preferably no more than about 15.3:

$$\text{Cr Eq.} = \text{Cr w/o} + \text{Mo w/o} + 1.5 \times \text{Si w/o}$$

$$\text{Ni Eq.} = 40\,(\text{C w/o} + \text{N w/o}) + \text{Ni w/o} + 0.5 \times (\text{cu w/o} + \text{Mn w/o}).$$

It is believed that such a value of chromium equivalent minus nickel equivalent can be used to provide a weld of this preferred steel (containing about 0.17 to 0.35 w/o nitrogen) with an austenite content of at least about 17%, as welded. Of course, reasonable care should be taken in welding and then cooling this preferred steel in order to be sure of obtaining at least about 17% austenite in the weld. Nevertheless, a weld can be provided with at least about 17% austenite simply by: (a) welding this preferred steel using techniques conventionally employed in commercial welding of stainless duplex austenitic-ferritic steel tubing or vessels (e.g., by GTA); and (b) then allowing the weld area to cool in any manner that is (i) conventionally used in commercial welding of such steel tubing or vessels and (ii) slow enough so that at least about 17% austenite forms in the weld as the weld cools. However, the cooling of the weld should not be so slow as to cause excessive carbonitride precipitation in the weld which could reduce its pitting and/or intergranular corrosion resistance.

It is believed that an austenite content of at least about 17% in a weld of a preferred steel of this invention, containing about 0.17 to 0.35 w/o nitrogen, provides the weld and the high-temperature heat affected zone of the steel, in the as-welded condition, with improved pitting and intergranular corrosion resistance, even without subsequent annealing of the weld area. In this regard, a weld in a preferred steel of the invention can contain up to about 50%, but typically no more than about 25%, austenite in the as-welded condition. Austenite reduces the continuity and the amount of ferrite-to-ferrite grain boundaries in welds of the steel. As a result, austenite reduces the amount and continuity of chromium-rich carbides and carbonitrides which can form at ferrite-to-ferrite grain boundaries in the welds. This prevents the chromium from being depleted from the adjacent ferrite matrix.

However, the advantages of providing at least about 17% austenite in a weld are not confined to the preferred steel of this invention containing about 0.17 to 0.35 w/o nitrogen. The intergranular corrosion resistance of a weld, in the as-welded condition, can be improved by providing at least about 17% austenite in the weld for any stainless duplex ferritic-austenitic steel consisting essentially of about:

| Elements | w/o |
|---|---|
| C | .01–.03 |
| Mn | 3 Max. |
| Si | 1 Max. |
| Cr | 11–30 |
| Ni | 3.5–20 |
| Mo | 3.5 Max. |
| Cu | 2 Max. |
| B | .005 Max. |
| N | 0.10–0.35 |

where the balance of the steel is essentially iron. In addition, the pitting resistance of a weld, in the as-welded condition, can be improved by providing at least about 17% austenite in the weld for any of the aforementioned duplex steels wherein nickel is limited to about 3.5 to 5.2 w/o.

Where large ferrite grains with extensive and continuous ferrite-to-ferrite grain boundaries, containing carbides and carbonitrides, are more likely to be formed in the steel of this invention during processing, as in large section-size pieces, it is also preferred that the parent or base metal of the steel have an austenite content of at least about 30%, better yet at least about 40%, up to about 60%. The austenite present in the base metal reduces the tendency to form larger ferritic grains and thereby improves the impact strength and tensile ductility of the steel. As in the case of the weld area, the austenite present also reduces the continuity and amount of the carbides and carbonitrides which can form at ferrite-to-ferrite grain boundaries and thereby improves the pitting and intergranular corrosion resistance of the steel. However, the base metal of the steel of this invention can, if desired, contain somewhat less than the preferred amount of austenite, i.e., down to about 25% austenite.

No special techniques are required in melting, casting and working the steel of this invention. In general, arc melting with argon-oxygen decarburization, is preferred, but other practices can be used. In some instances, an initial ingot, cast as an electrode, can be remelted, or powder metallurgy techniques can be used to provide better control of unwanted constituents or phases. Good hot workability is attained by hot working from a furnace temperature of about 2050 F (about 1120 C), preferably from about 1950 F (about 1065 C), and reheating as necessary. Process annealing is carried out above about 1750 F (about 955 C), preferably at about 1850 to 1950 F (about 1010 to 1065 C), for a time depending upon the dimensions of the article which is then preferably quenched in water.

The steel of this invention is suitable for forming to a great variety of shapes and products for a wide variety of uses, for which Type 329 steel has heretofore been used. The steel of this invention lends itself to the formation of billets, bars, rod, wire, strip, plate or sheet using conventional practices. The steel of this invention is particularly suited to be used in cold rolled, annealed sheet or strip and hot rolled, annealed plate that are to be welded. As compared to Type 329 steel, the steel of this invention has, inter alia: superior resistance to embrittlement when heated at about 700 to 1000 F (about 370 to 540 C) for prolonged periods; higher tensile strength in the base metal; and higher tensile strength in weld areas. As compared to Type 329 steel, the steel of this invention also has superior corrosion resistance, particularly intergranular corrosion and pitting resistance. The steel of this invention has especially superior intergranular corrosion and pitting resistance in weld areas, particularly in the as-welded condition. Moreover, like Type 329 steel, the corrosion resistance in weld areas of the steel of this invention can be improved by annealing to increase the austenite in the weld areas and to dissolve carbides, particularly intergranular carbides. In this regard, the steel of this invention can be annealed at about 1750 to 2050 F (about 950 to 1120 C), preferably about 1825 to 1950 F (about 995 to 1065 C), for as short as a few seconds or up to about 30 minutes, followed by air cooling.

The steel of this invention is advantageously used in the manufacture of tubing for use in heat exchangers or condensers. Because of its good weldability by conventional welding techniques, this steel is suitable for the manufacture of welded tubing, preferably by GTA welding. For some purposes, it is useful to provide this steel in the form of a weld filler wire.

Any minor amounts of sigma phase which may form in a steel of this invention, such as a preferred steel in which the total of chromium w/o plus nickel w/o plus molybdenum w/o is no more than about 34.0 and the total of nickel w/o plus molybdenum w/o is no more than about 7.0, can be removed in a conventional manner such as would be satisfactory for Type 329 steel. In this regard, sigma phase can be removed by heating or heating plus working of the steel followed by rapid cooling (e.g., air cooling of small section-sizes or water quenching of large section-sizes).

The heats A to V used in the examples, which follow, were prepared as small experimental heats, induction melted under argon. Heats A, B, J, N, R, T, U and V were each a steel of this invention ("invent."), and none of the other heats was a steel of this invention. The heats were analyzed as set forth in Table I, below. The tolerances for the anlayses did not exceed: ±0.003 w/o for carbon; ±0.02 w/o for manganese and for silicon; ±0.08 w/o for nickel; ±0.05 w/o for molybdenum; ±0.18 w/o for chromium; ±0.01 w/o for 0.10 to 0.19 w/o nitrogen; and ±0.02 w/o for 0.20 to 0.49 w/o nitrogen.

Each heat was hot worked to form a strip, annealed as required, cold rolled to .125 inch (.3 cm) thickness, annealed in neutral salt at 1850 F (1010 C) for three minutes and then air cooled. The austenite content of the base metal of each strip was determined by x-ray diffraction to ±2% of the reported value. The austenite content of the base metal of each strip is set forth in Table I, below.

Welding of a strip from each heat, when carried out in the examples, was carried out with a GTA apparatus, and after welding, the strip was cooled at a rate which approximated conventional commercial weld-cooling rates. The austenite content of the weld area of each strip was determined by point counting of one typical field using 300 intersections at 500X magnification. The austenite content of the weld of each strip is set forth in Table I, below.

TABLE I

| | Elements* (w/o) | | | | | | | | | | Austenite | |
|---|---|---|---|---|---|---|---|---|---|---|---|---|
| Heats | C | Mn | Si | P | S | Cr | Ni | Mo | Cu** | N | Base Metal (%) | Weld (%) |
| A (invent.) | .024 | .37 | .31 | .020 | .008 | 26.19 | 4.79 | 1.44 | N.A. | .21 | 45 | N.A. |
| B (invent.) | .024 | .38 | .32 | .021 | 008 | 26.47 | 4.83 | 1.44 | N.A. | .20 | 40 | 24 |
| C | .056 | .40 | .32 | .020 | .008 | 26.36 | 4.81 | 1.44 | N.A. | .22 | 54 | 30 |
| D | .052 | .39 | .32 | .021 | .008 | 27.00 | 4.86 | 1.44 | N.A. | .20 | 42 | 21 |
| E | .023 | .39 | .32 | .020 | .007 | 26.55 | 5.55 | 1.44 | N.A. | .19 | 48 | 21 |
| F | .026 | .38 | .32 | .021 | .007 | 26.76 | 5.56 | 1.44 | N.A. | .18 | 44 | 20 |
| G | .025 | .38 | .33 | .023 | .007 | 26.95 | 6.13 | 1.43 | N.A. | .16 | 46 | 18 |
| H | .027 | .40 | .33 | .022 | .007 | 27.11 | 6.21 | 1.45 | N.A. | .15 | 44 | 11 |
| I | .025 | .42 | .32 | .021 | .008 | 25.73 | 4.84 | 1.43 | N.A. | .17 | 48 | N.A. |
| J (invent.) | .026 | .42 | .32 | .021 | .008 | 26.98 | 4.82 | 1.43 | N.A. | .15 | 40 | 15 |
| K | .026 | .42 | .34 | .023 | .007 | 26.64 | 4.76 | 1.44 | N.A. | .13 | 36 | 5 |
| L | .025 | .42 | .32 | .021 | .007 | 26.88 | 4.78 | 1.42 | N.A. | .13 | 40 | 6 |
| M | .021 | .41 | .34 | .021 | .008 | 27.19 | 5.47 | 1.43 | N.A. | .15 | 39 | 11 |
| N (invent.) | .030 | .38 | .34 | .022 | .007 | 26.54 | 4.94 | 1.46 | N.A. | .19 | 40 | 19 |
| O | .023 | .40 | .35 | .020 | .008 | 26.68 | 6.32 | 1.47 | N.A. | .20 | 47 | 22 |
| P | .027 | .38 | .32 | .019 | .008 | 27.21 | 6.20 | 1.41 | N.A. | .20 | 43 | 23 |
| Q | .026 | .39 | .32 | .017 | .007 | 25.48 | 4.92 | 1.43 | N.A. | .20 | 43 | N.A. |
| R (invent.) | .028 | .38 | .34 | .022 | .007 | 27.15 | 4.76 | 1.48 | N.A. | .20 | 41 | 22 |
| S | .028 | .40 | .34 | .021 | .007 | 27.06 | 5.45 | 1.46 | N.A. | .19 | 43 | N.A. |
| T (invent.) | .021 | .42 | .36 | .019 | .008 | 26.69 | 4.80 | 2.36 | .02 | .21 | N.A. | N.A. |
| U (invent.) | .021 | .44 | .40 | .023 | .008 | 26.29 | 4.70 | 2.35 | .02 | .19 | N.A. | N.A. |
| V (invent.) | .021 | .44 | .39 | .025 | .008 | 26.25 | 4.82 | 2.36 | .84 | .18 | N.A. | N.A. |

*Oxygen was no more than about .02 w/o.
**Copper, when not analyzed ("N.A."), did not exceed about .05 w/o.

EXAMPLE 1

The hardness of strips from certain heats was determined after: a) annealing each strip in salt at 1850 F (1010 C) for three minutes and then air cooling; and b) annealing each strip as in a), followed by heat treating each strip at 1400 F (760 C) for two hours and then air cooling. The results are set forth in Table II, below.

TABLE II

| | Elements | | | Annealed | Heat Treated |
|---|---|---|---|---|---|
| Heats | Cr (w/o) | Ni (w/o) | Mo (w/o) | Hardness (Rc) | Hardness (Rc) |
| R (invent.) | 27.15 | 4.76 | 1.48 | 21.8 | 24.5 |
| J (invent.) | 26.98 | 4.82 | 1.43 | 20.5 | 24.7 |
| B (invent.) | 26.47 | 4.83 | 1.44 | 21.9 | 23.1 |
| N (invent.) | 26.54 | 4.94 | 1.46 | 21.1 | 23.1 |

TABLE II-continued

| Heats | Elements Cr (w/o) | Ni (w/o) | Mo (w/o) | Annealed Hardness (Rc) | Heat Treated Hardness (Rc) |
|---|---|---|---|---|---|
| S | 27.06 | 5.45 | 1.46 | 21.7 | 31.8 |
| M | 27.19 | 5.47 | 1.43 | 21.2 | 31.5 |
| E | 26.55 | 5.55 | 1.44 | 22.7 | 32.2 |
| F | 26.76 | 5.56 | 1.44 | 22.4 | 32.5 |
| G | 26.95 | 6.13 | 1.43 | 22.0 | 37.9 |
| P | 27.21 | 6.20 | 1.41 | 22.6 | 35.8 |
| H | 27.11 | 6.21 | 1.45 | 21.0 | 40.5 |
| 0 | 26.68 | 6.32 | 1.47 | 22.3 | 37.5 |
| T (invent.) | 26.69 | 4.80 | 2.36 | 23.3 | 36.0 |
| U (invent.) | 26.29 | 4.70 | 2.35 | 22.2 | 36.9 |
| V (invent.) | 26.25 | 4.82 | 2.36 | 22.8 | 36.7 |

Table II shows that, in a preferred steel of this invention in heats B, J, N and R, the use of no more than about 5.2 w/o nickel, a total of chromium w/o plus nickel w/o plus molybdenum w/o of no more than about 34.0, and a total of nickel w/o plus molybdenum w/o of no more than about 7.0 prevents the hardness of the preferred steel from exceeding about Rc 30 when the steel is heated at about 1400 F (760 C) for two hours and then air cooled. This indicates that any sigma phase, which may form in the preferred steel, will not significantly impair the hot workability or the corrosion resistance of the steel and can be removed by conventional heating or heating plus working techniques in making a finished product.

EXAMPLE 2

The intergranular corrosion resistance, as welded, of strips from certain heats was determined in ferric sulfate plus sulfuric acid (ASTM A262-B). The test was significantly more severe than ASTM A262-B, because three periods of 120 hours each were used. Each strip had been welded and machine ground to a 1.25×1×0.125 inch (3.2×2.5×0.3 cm) sample with a 120 grit finish before being tested.

The results are set forth in Tables IIIA and IIIB, below. Corrosion rates were determined in mils per year (MPY) and converted to millimeters per year (MMPY). The depth of attack in the weld and the high-temperature heat affected zone (HAZ), immediately adjacent the weld, was measured in inches, using cross-sections of the weld areas, and converted to centimeters.

TABLE III

| Heats | Elements C w/o | N w/o | Austenite in Weld (%) | Corrosion Rates In 120 Hour Periods: 1st Period (MPY) | 1st Period (MMPY) | 2nd Period (MPY) | 2nd Period (MMPY) | 3rd Period (MPY) | 3rd Period (MMPY) |
|---|---|---|---|---|---|---|---|---|---|
| C | .056 | .22 | 30 | 19.4 | .49 | 32.2 | .82 | 56.6 | 1.44 |
| D | .052 | .20 | 21 | 21.0 | .53 | 44.1 | 1.12 | 56.2 | 1.43 |
| B (invent.) | .024 | .20 | 24 | 16.4 | .42 | 19.1 | .49 | 22.0 | .56 |
| J (invent.) | .026 | .15 | 15 | 19.9 | .51 | 35.8 | .91 | 46.8 | 1.19 |
| K | .026 | .13 | 5 | 22.7 | .58 | 38.8 | .99 | 48.9 | 1.24 |
| L | .025 | .13 | 6 | 22.9 | .58 | 57.0 | 1.45 | 81.1 | 2.06 |
| N (invent.) | .030 | .19 | 19 | 20.1 | .51 | 29.7 | .75 | 31.2 | .79 |
| R (invent.) | .028 | .20 | 22 | 21.5 | .55 | 26.1 | .66 | 25.0 | .64 |

| Heats | Depth of Attack After 1st 120 Hr. Period: Weld (inches) | Weld (cm) | HAZ (inches) | HAZ (cm) | Depth of Attack After 3rd 120 Hr. Period: Weld (inches) | Weld (cm) | HAZ (inches) | HAZ (cm) |
|---|---|---|---|---|---|---|---|---|
| C | .0042 | .011 | .0065 | .017 | .0076 | .019 | .0118 | .030 |
| D | .0057 | .014 | .0053 | .014 | .0118 | .030 | .0193 | .049 |
| B (invent.) | .0025 | .006 | .0021 | .005 | .0047 | .012 | .0069 | .018 |
| J (invent.) | .0082 | .021 | .0086 | .022 | .0114 | .029 | .0224 | .057 |
| K | .0037 | .009 | .0065 | .017 | .0155 | .039 | .0264 | .067 |
| L | .0074 | .019 | .0043 | .011 | .0215 | .055 | .0396 | .101 |
| N (invent.) | .0036 | .009 | .0024 | .006 | .0076 | .019 | .0068 | .017 |
| R (invent.) | .0031 | .008 | .0029 | .007 | .0060 | .015 | .0066 | .017 |

Tables IIIA and IIIB show that, in a preferred steel of this invention in heats B, N and R as welded, the use of more than about 0.15 w/o (i.e., at least about 0.17 w/o) nitrogen and no more than about 0.03 w/o carbon and the presence of more than about 15% (i.e., at least about 17%) austenite in the weld provides improved intergranular corrosion resistance in the weld and the heat affected zone of the steel, particularly after the third period of exposure to ferric sulfate plus sulfuric acid.

EXAMPLE 3

The general corrosion resistance of strips from certain heats was determined in boiling 65 w/o nitric acid for five 48 hour periods (ASTM A262-C). The test was significantly more severe than ASTM A-262C, because the nitric acid contained 0.5 g/l potassium dichromate so that it provided a severe oxidizing environment such as is found in nitric acid heated above its atmospheric boiling point (e.g., in a nitric acid cooler-condenser). Each strip had been hand ground to an approximately 1.5×0.5×0.125 inch (3.8×1.3×0.3 cm) sample with a 120 grit finish before being tested.

The results are set forth in Tables IVA and IVB, below, for duplicate test strips. Corrosion rates were determined in mils per year (MPY) and converted to millimeters per year (MMPY).

TABLE IV

| Heats | Elements Cr w/o | N w/o | Corrosion Rates In 48 Hour Periods: 1st Period (MPY) | 1st Period (MMPY) | 2nd Period MPY | 2nd Period (MMPY) | 3rd Period (MPY) | 3rd Period (MMPY) |
|---|---|---|---|---|---|---|---|---|
| Q | 25.48 | .20 | 581/554 | 14.8/14.1 | 284/353 | 7.2/9.0 | 474/523 | 12.0/13.3 |
| I | 25.73 | .17 | 297/281 | 7.5/7.1 | 407/365 | 10.3/9.3 | 246/242 | 6.2/6.1 |
| A (invent.) | 26.19 | .21 | 257/243 | 6.5/6.2 | 392/356 | 10.0/9.0 | 456/437 | 11.6/11.1 |

TABLE IV-continued

| | | | | | | | | |
|---|---|---|---|---|---|---|---|---|
| J (invent.) | 26.98 | .15 | 75/77 | 1.9/2.0 | 283/272 | 7.2/6.9 | 208/199 | 5.3/5.1 |

| | Corrosion Rates In 48 Hour Periods | | | | Average of Periods Tested | |
|---|---|---|---|---|---|---|
| | 4th Period | | 5th Period | | | |
| Heats | (MPY) | (MMPY) | (MPY) | (MMPY) | (MPY) | (MMPY) |
| Q | 337/469 | 8.6/11.9 | 198/192 | 5.0/4.9 | 375/418 | 9.5/10.6 |
| I | 419/355 | 10.6/9.0 | 435/532 | 11.0/13.5 | 361/355 | 9.2/9.0 |
| A (invent.) | 300/308 | 7.6/7.8 | 146/154 | 3.7/3.9 | 311/300 | 7.9/7.6 |
| J (invent.) | 164/134 | 4.2/3.4 | 318/319 | 8.1/8.1 | 210/200 | 5.3/5.1 |

Tables IVA and IVB show that, in the steel of this invention in heats A and J, the use of at least about 26.0 w/o chromium provides improved general corrosion resistance.

EXAMPLE 4

The pitting resistance of strips from certain heats was determined in 6 w/o ferric chloride (solution from ASTM-G48). The tests were carried out at 40 C, and each strip was immersed in 150 ml of ferric chloride solution for 72 hours. Each strip had been welded, annealed at 1850 F (1010 C) for 10 minutes, air cooled and then machine ground to a 1.25×1×0.125 inch (3×2.5×0.3 cm) sample with a 120 grit finish before being tested.

The results are set forth in Table V, below, for duplicate test strips. Corrosion rates were determined in milligrams per square centimeter (Mg/cm$^2$). No strip was observed to have suffered preferential attack in its weld area.

TABLE V

| | Elements | | | | Corrosion |
|---|---|---|---|---|---|
| Heats | C w/o | Cr w/o | Ni w/o | N w/o | Rates (Mg/cm$^2$) |
| B (invent.) | .024 | 26.47 | 4.83 | .20 | 0/0 |
| K | .026 | 26.64 | 4.76 | .13 | 1.4/2.0 |
| L | .025 | 26.88 | 4.78 | .13 | 2.3/3.0 |
| N (invent.) | .030 | 26.54 | 4.94 | .19 | .1/1.3 |
| R (invent.) | .028 | 27.15 | 4.76 | .21 | 1.2/0 |

Table V shows that, in a preferred steel of this invention in heats B, N and R as welded plus annealed, the use of more than about 0.13 w/o (i.e., at least about 0.17 w/o) nitrogen provides improved pitting resistance.

EXAMPLE 5

The pitting resistance of strips from certain heats was determined in 6 w/o ferric chloride at 22 C for three days (ASTM-G48). Unlike ASTM-G48, each strip was immersed in 150 ml of ferric chloride solution in the tests. Each strip had been welded and then machine ground as in Example 4 before being tested.

The results are set forth in Table VI, below, for duplicate test strips. Corrosion rates were determined in milligrams per square centimeter (Mg/cm$^2$). The test strips also were visually compared at the end of the tests to determine the relative extent of pitting which had been suffered. The pitting resistance of the strips was rated either good (G), moderate (M) or bad (B) from this visual comparison.

TABLE VI

| | Elements | | | | Austenite in | Corrosion | |
|---|---|---|---|---|---|---|---|
| Heats | C w/o | Cr w/o | Ni w/o | N w/o | Weld (%) | Rates (Mg/cm$^2$) | Visual Ratings |
| B | .024 | 26.47 | 4.83 | .20 | 24 | 1.7/2.6 | G |

TABLE VI-continued

| | Elements | | | | Austenite in | Corrosion | |
|---|---|---|---|---|---|---|---|
| Heats | C w/o | Cr w/o | Ni w/o | N w/o | Weld (%) | Rates (Mg/cm$^2$) | Visual Ratings |
| (invent.) | | | | | | | |
| J | .026 | 26.98 | 4.82 | .15 | 15 | 13.4/14.0 | B |
| (invent.) | | | | | | | |
| E | .023 | 26.55 | 5.55 | .19 | 21 | .8/.9 | G |
| F | .026 | 26.76 | 5.56 | .18 | 20 | 1.1/2.9 | G |
| M | .021 | 27.19 | 5.47 | .15 | 11 | 7.7/8.7 | B |
| G | .025 | 26.95 | 6.13 | .16 | 18 | 1.3/2.3 | G/M |
| H | .027 | 27.11 | 6.21 | .15 | 11 | 6.9/8.1 | B |

Table VI shows that, in a stainless duplex ferritic-austenitic steel such as the steel of this invention, as welded, the presence of at least about 17% austenite in the weld provides improved pitting resistance in the weld areas of the steel. Table VI also shows that, in a steel of this invention in heats B and J as welded, the use of more than about 0.15 w/o (i.e., at least about 0.17 w/o) nitrogen and the presence of more than about 15% (i.e., at least about 17%) austenite in the weld is preferred to provide improved pitting resistance in the weld areas of the steel.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

We claim:

1. A stainless duplex ferritic-austenitic steel consisting essentially in weight percent of about:

| Elements | w/o |
|---|---|
| C | .03 Max. |
| Mn | 3.0 Max. |
| Si | 1.0 Max. |
| Cr | 26.0–29.0 |
| Ni | 3.5–5.2 |
| Mo | 1.0–3.5 |
| Cu | 2.0 Max. |
| B | .005 Max. |
| N | 0.15–0.4 |

the balance of the steel being essentially iron; the total of chromium w/o plus nickel w/o plus molybdenum w/o being no more than about 34.0; and the total of nickel w/o plus molybdenum w/o being no more than about 7.0.

2. The steel of claim 1 wherein nitrogen is about 0.17 to 0.35 w/o.

3. The steel of claim 2 wherein the elements are balanced to provide a weld of the steel with at least about 17% austenite and enhanced intergranular corrosion resistance and pitting resistance in the as-welded condition.

4. The steel of claim 3 wherein the chromium equivalent minus the nickel equivalent is no more than about 16.4.

5. The steel of claim 3 wherein the chromium equivalent minus the nickel equivalent is no more than about 15.3.

6. The steel of claim 3 wherein nickel is about 4.0 to 5.0 w/o.

7. The steel of claim 5 wherein molybdenum is about 1.0 to 2.5 w/o.

8. The steel of claim 6 wherein chromium is about 26.0 to 28.0 w/o.

9. The steel of claim 8 wherein manganese is about 1.0 w/o Max.

10. The steel of claim 1 which contains about:

| Elements | w/o |
|---|---|
| C | .01–.028 |
| Mn | 1.0 Max. |
| Si | 0.75 Max. |
| Cr | 26.0–28.0 |
| Ni | 4.0–5.0 |
| Mo | 1.0–2.5 |
| Cu | 1.0 Max. |
| N | 0.17–0.35 |

11. The steel of claim 10 wherein the chromium equivalent minus the nickel equivalent is no more than about 16.4.

12. The steel of claim 11 wherein the chromium equivalent minus the nickel equivalent is no more than about 15.3.

13. The steel of claim 1 which contains about:

| Elements | w/o |
|---|---|
| C | .015–.025 |
| Mn | 0.5 Max. |
| Si | 0.5 Max. |
| Cr | 26.5–27.5 |
| Ni | 4.5–5.0 |
| Mo | 1.25–2.25 |
| Cu | 1.0 Max. |
| N | 0.18–0.28 |

14. The steel of claim 13 wherein the chromium equivalent minus the nickel equivalent is no more than about 16.4.

15. The steel of claim 14 wherein the chromium equivalent minus the nickel equivalent is no more than about 15.3.

16. A hot rolled, annealed plus welded plate made from the stainless duplex ferritic-austenitic steel of claim 4.

17. The plate of claim 16 wherein the chromium equivalent minus the nickel equivalent of the steel is no more than about 15.3.

18. A cold rolled, annealed plus welded sheet or strip made from the stainless duplex ferritic-austenitic steel of claim 3.

19. The sheet or strip of claim 18 wherein the chromium equivalent minus the nickel equivalent of the steel is no more than about 15.3.

20. A welded article made from the stainless duplex ferritic-austenitic steel of claim 4.

21. The article of claim 20 wherein the chromium equivalent minus the nickel equivalent of the steel is no more than about 15.3.

22. A stainless duplex ferritic-austenitic steel consisting essentially of about:

| Elements | w/o |
|---|---|
| C | .03 Max. |
| Mn | 3.0 Max. |
| Si | 1.0 Max. |
| Cr | 26.0–29.0 |
| Ni | 3.5–5.2 |
| Mo | 1.0–2.5 |
| Cu | 2.0 Max. |
| B | .005 Max. |
| N | 0.15–0.40 |

the balance of the steel being essentially iron, the total of chromium w/o plus nickel w/o plus molybdenum w/o being no more than about 34, and the total of nickel w/o plus molybdenum w/o being no more than about 7.

23. The steel of claim 22 wherein nitrogen is about 0.17 to 0.35 w/o.

24. The steel of claim 22 wherein the elements are balanced to provide a weld of the steel with at least about 17% austenite and enhanced intergranular corrosion resistance and pitting resistance in the as-welded condition.

25. The steel of claim 24 wherein the chromium equivalent minus the nickel equivalent is no more than about 16.4.

26. A hot rolled, annealed plus welded plate made from the stainless duplex ferritic-austenitic steel of claim 25.

27. The plate of claim 26 wherein the chromium equivalent minus the nickel equivalent of the steel is no more than about 15.3.

28. A cold rolled, annealed plus welded sheet or strip made from the stainless duplex ferritic-austenitic steel of claim 25.

29. The sheet or strip of claim 28 wherein the chromium equivalent minus the nickel equivalent of the steel is no more than about 15.3.

30. A welded article made from the stainless duplex ferritic-austenitic steel of claim 25.

31. The article of claim 30 wherein the chromium equivalent minus the nickel equivalent of the steel is no more than about 15.3.

* * * * *